US006519879B2

(12) United States Patent
Gee

(10) Patent No.: US 6,519,879 B2
(45) Date of Patent: Feb. 18, 2003

(54) GOLF SHOE SOFT SPIKE/CLEAT DESIGN

(75) Inventor: Patrick Gee, Covina, CA (US)

(73) Assignee: HYI, Covina, CA (US)

( * ) Notice: Subject to any disclaimer, the term of this patent is extended or adjusted under 35 U.S.C. 154(b) by 0 days.

(21) Appl. No.: 09/729,755

(22) Filed: Dec. 4, 2000

(65) Prior Publication Data

US 2002/0069559 A1 Jun. 13, 2002

(51) Int. Cl.[7] ..... A43C 15/00; A43B 5/00

(52) U.S. Cl. ..... 36/134; 36/65; 36/67 A; 36/67 D

(58) Field of Search ..... 36/134, 62, 65, 36/66, 67 R, 67 A, 67 D, 59 A, 59 B, 59 C, 127; D2/906, 746, 947, 967

(56) References Cited

U.S. PATENT DOCUMENTS

| | | | | |
|---|---|---|---|---|
| 2,394,454 A | * | 2/1946 | Kappeler | 36/59 C |
| 2,433,303 A | * | 12/1947 | Spini | 36/59 C |
| 2,888,756 A | * | 6/1959 | Parsons | 36/59 R |
| 4,723,366 A | | 2/1988 | Hagger | |
| 5,029,405 A | | 7/1991 | DeHaitre | |
| 5,259,129 A | | 11/1993 | Deacon et al. | |
| 5,367,793 A | | 11/1994 | Deacon et al. | |
| D371,453 S | | 7/1996 | Deacon et al. | |
| D390,693 S | | 2/1998 | Curley, Jr. | |
| D392,451 S | | 3/1998 | Collins et al. | |
| D395,542 S | | 6/1998 | Collins | |
| 5,761,833 A | | 6/1998 | McMullin | |
| 5,782,017 A | | 7/1998 | Ortscheid | |
| 5,791,071 A | | 8/1998 | Rosdail | |
| 5,794,367 A | | 8/1998 | Carroll | |
| D398,749 S | | 9/1998 | Santos | |
| D401,750 S | | 12/1998 | Santos et al. | |
| D401,752 S | | 12/1998 | Santos et al. | |
| D402,801 S | | 12/1998 | Santos et al. | |
| D404,192 S | | 1/1999 | McMullin | |
| 5,887,371 A | | 3/1999 | Curley, Jr. | |
| D407,893 S | | 4/1999 | McMullin | |
| D408,122 S | | 4/1999 | McMullin | |
| 5,901,472 A | | 5/1999 | Adam | |
| 5,906,059 A | | 5/1999 | Singer et al. | |
| D410,693 S | | 6/1999 | Brockman | |
| 5,940,993 A | | 8/1999 | Ronci | |
| D415,340 S | | 10/1999 | McMullin | |
| D415,341 S | | 10/1999 | Niikura | |
| 5,992,059 A | | 11/1999 | Bettenga et al. | |
| D417,546 S | | 12/1999 | Curley, Jr. | |
| 5,996,260 A | | 12/1999 | MacNeill | |
| 6,006,454 A | | 12/1999 | Sitzler, Sr. | |
| 6,009,640 A | | 1/2000 | Deacon et al. | |
| D421,175 S | | 2/2000 | Singer | |
| 6,023,860 A | | 2/2000 | McMullin | |
| 6,041,526 A | | 3/2000 | Collins | |
| 6,052,923 A | | 4/2000 | McMullin | |
| 6,233,850 B1 | * | 5/2001 | Peabody | 36/134 |

FOREIGN PATENT DOCUMENTS

| | | | | |
|---|---|---|---|---|
| EP | 0524861 A1 | * | 1/1993 | 36/134 |

* cited by examiner

*Primary Examiner*—Anthony D. Stashick
(74) *Attorney, Agent, or Firm*—Fulwider Patton Lee & Utecht, LLP

(57) ABSTRACT

The invention relates to a cleat for providing traction for footwear. The cleat provides traction and durability without damaging turf when in use.

13 Claims, 1 Drawing Sheet

GOLF SHOE SOFT SPIKE/CLEAT DESIGN

BACKGROUND OF THE INVENTION

Standard footwear often does not provide sufficient traction for various activities. Sporting events typically require the athlete to play in such a manner and in such conditions that more traction is required. Therefore, the prior art has provided various forms of spikes or cleats to furnish this traction. Quite often the spikes or cleats are removable and replaceable within the footwear.

Golf requires a substantial amount of traction for the golfer on fairways, roughs or greens (all surfaces which are generically referred to as "turf.") While prior art cleats have been able to supply the required traction, these cleats often created an unacceptable amount of damage to the turf. Some cleats have in fact been banned from golf courses concerned about the condition of the turf.

For this reason, the prior art has provided a number of "alternative"-style cleats. These cleats attempted to provide the required traction without damaging the turf A common configuration of such cleats included a plurality of very flexible prongs. Many of these cleats failed to strike an appropriate balance between providing traction and preventing turf damage. Furthermore, many of these cleats were not durable enough when the golfer was forced to walk on hard surfaces, such as cart paths or parking lots.

The prior art alternative-style cleats have taught the use of highly flexible plastics which allow a great deal of bending in the prongs. One example, is the use of polyester estane manufactured by B.F. Goodrich with a measurement between 92 to 93A on the Shore Hardness scale. Such a material allows the prongs of the prior art alternative-style cleat to bend flat when the weight of the golfer is placed upon them.

What has been lacking in the prior art is a cleat which can provide traction, prevent turf damage and be durable against hard surfaces.

SUMMARY OF THE INVENTION

The cleat described herein combines the features of durability and traction without damaging turf. The cleat is comprised of a male threaded post for attaching to the sole of a sport shoe through the use of a female receptacle, a base and a plurality of protrusions. The plurality of protrusions may be "L"-shaped and configured about the central base. Such a configuration provides superior traction.

The protrusions may be canted downwardly and outwardly such that the cleat digs into the turf starting near the perimeter of the cleat. The material of the cleat is stiff enough such that the cleat does not flex appreciably when used on turf. The base of the cleat does not project downward as far as the protrusions such that the base does not come into contact with the turf.

The material of the cleat is also flexible enough such that the protrusions flex upward when in use on a hard surface. The protrusions flex upward starting from the circumference of the cleat until the entire protrusion is no longer canted and lies flat against the hard surface. In this manner the protrusions create a large durable wear surface against the hard surface. This feature provides the superior durability of the cleat. The cleat is also larger in diameter to give it more surface contact area.

DETAILED DESCRIPTION OF THE PREFERRED EMBODIMENTS

The invention described herein relates generally to cleat 20 for securing a shoe to a turf surface. More particularly the invention relates to a durable cleat design which avoids damage to the turf surface. In general the invention comprises a base 22 and a plurality of protrusions 24 (also referred to as "turf engaging members") as well as a means for attaching the cleat to the shoe. Although many of the embodiments described herein relate to a detachable cleat, the invention may also include cleats that are integral with the sole of a shoe.

Figure 1:
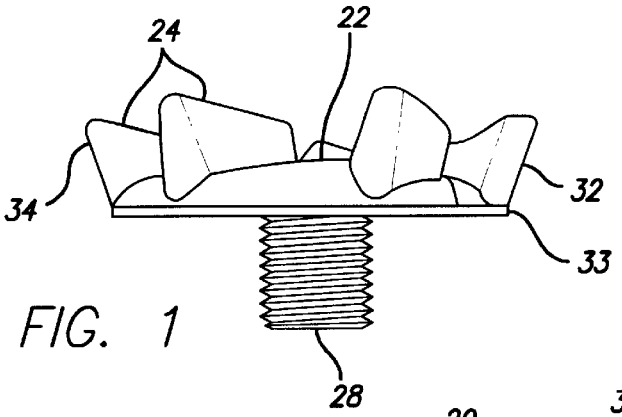
FIG. 1 is a view of a preferred embodiment of the cleat.

In a preferred embodiment of the invention, as shown in FIG. 1, the cleat 20 may be attachable to the sole of a sport shoe by a threaded post 28. It is known in the art of sport shoe design to provide a plurality of threaded receptacles within the sole of the sport shoe to mate with such a threaded post. Thus the shoes known within the prior art are adapted to attach to a plurality of the preferred embodiment of the cleat as presented herein.

The preferred cleat comprises a base 22 centrally aligned with and facing away from the threaded post 28, and a plurality of protrusions 24 radiating outwardly from the base. The base of the preferred cleat forms a roughly circular outer edge 33 at the base's periphery. As shown in the bottom view, FIG. 2, each protrusion may be comprised of at least two portions. A radially inner portion 30 may be generally aligned radially with the base 22 (hereinafter simply the "inner portion"), whereas the radially outer portion 32 may be generally orthogonal to the radially inner portion (hereinafter simply the "outer portion"). This preferred embodiment forms a unitary "L" shaped protrusion with the inner portion shorter in depth than the outer portion. The protrusions are each preferably provided with a generally planar bottom or ground contact surface 25 which faces generally downwardly.

Figure 2:
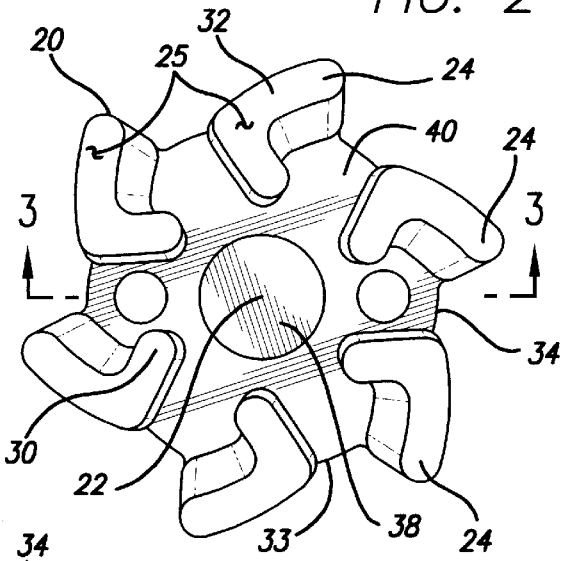
FIG. 2 is a bottom view of a preferred embodiment of the cleat.

As seen in FIG. 2 the inner portion 30 is not necessarily exactly radially aligned with the base 22, but is generally so aligned. Furthermore, the outer portion 32 need not be exactly orthogonal to the inner portion. Since the outer portion is generally orthogonal to the inner portion, however, the outer portion of each protrusion 24 lies on a circumferential outline having the post 28 as the center, and thereby forms a generally lowermost circumferential arrangement about the base 22 and remote from the base 22. The outer portions may also be curved so as to form a lowermost, somewhat circular perimeter 34 on the cleat 20 remote from the base 22. Thus, in a preferred embodiment, the outer lowermost perimeter 34 of the cleat may extend outwardly beyond the outer edge 33 of the base.

Figure 3:
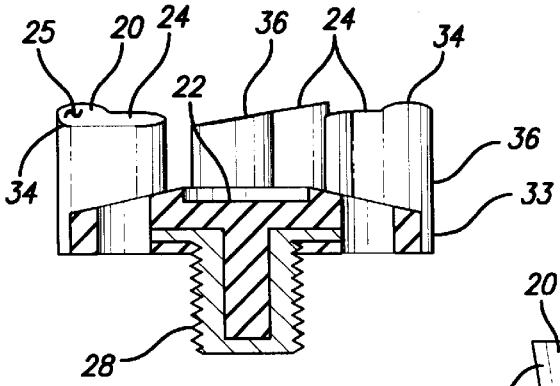
FIG. 3 is a cross-sectional side view taken along line AA in FIG. 2 while the cleat is not flexed.

A further feature of the plurality of protrusions 24, resides in that each is canted downwardly (away from the lower surface of the base 22) as the protrusions extend toward the perimeter 34. This canting 36, as shown in FIG. 3, configures the cleat 20 such that it extends further downwardly towards the perimeter 34. In a preferred embodiment, the lower surface of the base 22 does not extend downwardly with respect to any portion of the plurality of protrusions 24.

In the just-described configuration, the cleat 20, when in contact with a soft surface (e.g. turf), projects into the surface at the perimeter 34 of the cleat. The cleat is preferably made of a material stiff enough (for example, greater than 93A on the Shore Hardness Scale) that it does not substantially flex when in contact with such a soft surface. Certain forms of plastic are known to have the required stiffness for this purpose. One example known to work particularly well for this application is polyurethane manufactured by BASF with a measurement of 95A on the Shore Hardness scale.

Having the "L"-shaped protrusions 24 in a circumferentially arranged configuration projecting into turf at the perimeter 34 of the cleat 22 provides ideal traction for a sport shoe without the corresponding damage to the turf known in prior art cleats. Thus the preferred arrangement of the protrusions about the cleat provides superior traction.

Figure 4:
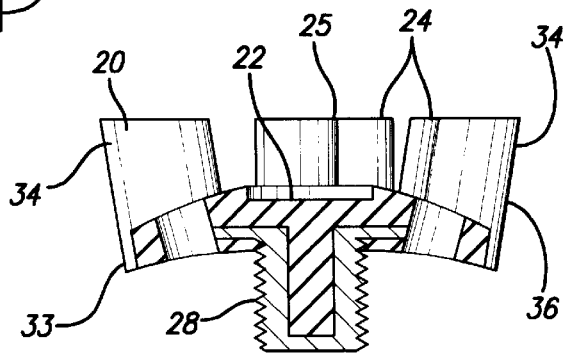
FIG. 4 is a cross-sectional side view taken along line AA in FIG. 2 while the cleat is flexed

When pressed against a hard surface (e.g. a parking lot surface) the plurality of protrusions 24 preferably flex until they are level with the surface (see FIG. 4). The same polyurethane material is known to be flexible enough for this purpose. As shown in FIG. 4 the plurality of protrusions will flex upwardly (toward the lower surface of the base 22) until the protrusions 24 lie on a plane generally parallel with the lower surface of base 22. In this configuration, the entire bottom surface 25 of each protrusion 24 is substantially flattened against the hard surface. Preferably no portion of the base 22 will contact the hard surface. Having the bottom surface 25 of each protrusion flattened against a hard surface provides a large traction and wear surface. Combined with the relatively stiff material of the cleat, this large wear surface provides the cleat 20 with superior durability.

Whereas the base 22 and protrusions 24 of the cleat 20 may be made of a relatively stiff plastic, the threaded post 28 is often made of a metal. It is known in the prior art how to mold a polyurethane structure onto a metallic threaded post so as to form a cleat. This is accomplished by placing a pre-fabricated metal post within the mold for a polyurethane cleat either prior to inserting the polyurethane or prior to the hardening of the polyurethane.

In a preferred arrangement, the base 22 includes a central portion 38, and an outer portion 40. The central portion covers an area including and surrounding the centralmost point (or axis) of the base. The protrusions 24 each reside within the area of the outer portion, thus leaving the inner portion free of protrusions. When compressed against a hard or relatively soft surface, the protrusions contact the surface at or near the outer portion of the base, but the cleat does not contact the surface at the central portion of the base.

This novel cleat may be used for a variety of footwear. One purpose may be for a golf shoe. The benefits of this novel cleat, however, are not limited to the sport of golf. Many sports require shoes with good traction. Furthermore, traction may also be required in work boots or for other non-sporting applications. This cleat would work as well in those applications.

While the foregoing has been a description of the invention's preferred embodiments, it will be understood that the invention is not limited to those embodiments. Those of skill in the appropriate art will readily appreciate that the cleat described herein may be altered without removing such cleat from the scope of the invention. Thus the scope of the invention is intended to be limited only by the following claims.

What is claimed is:

1. A cleat for providing traction with the ground, comprising:

a base having an upper surface, a lower surface and an outer edge;

a threaded post extending upwardly from said upper surface and configured to attach to a shoe;

a plurality of protrusions extending downwardly from said lower surface adjacent said outer edge;

each protrusion forming an L-shaped ground contact surface; and each ground contact surface is canted downwardly in the direction of the outer edge;

wherein the ground contact surfaces are configured to rigidly protrude into soft ground and to flex toward a horizontal configuration when compressed by hard ground.

2. The cleat of claim 1, wherein the base has a central lower surface;

and the protrusions prevent contact between the ground and the central lower surface.

3. The cleat of claim 2, wherein each protrusion comprises a short inner portion which extends outwardly from the central lower surface, and a longer outer portion which extends orthogonally from the inner portion, to form the L-shaped ground contact surface.

4. The cleat of claim 3, wherein the protrusions are radially aligned about the central lower surface.

5. A cleat, comprising:

a threaded post for attachment to the sole of a shoe;

a base attached to the threaded post having an upper surface, a lower surface and an outer edge;

a plurality of protrusions extending downwardly from the lower surface configured to bear the weight of the wearer;

the plurality of protrusions are configured to minimize damage to a soft turf surface by continually canting downwardly as the protrusions extend outwardly;

the plurality of protrusions are formed of a stiff plastic material such that the protrusions do not substantially flex when in contact with a soft turf surface; and wherein the protrusions are also configured to flatten to an uncanted condition when compressed in contact with a hard surface.

6. The cleat of claim 5, wherein the protrusions are configured to minimize damage to a turf surface by forming a plurality of "L" shapes disposed generally radially about the base.

7. A turf protecting cleat, comprising:

a base having a central portion which spans from a centralmost point of the cleat and radiates outwardly to an outer portion which spans from the central portion to an outer edge;

a plurality of turf engaging members protruding downwardly from the outer portion and extending outwardly toward an outer perimeter of the cleat;

the turf engaging members having a continuous downward cant as each turf engaging member extends toward the outer perimeter of the cleat;

wherein the cleat protrudes furthest into the turf at the outer perimeter, the cleat protrudes into the turf gradually less throughout the outer portion towards the central portion and the cleat does not protrude into the turf at the central portion; and wherein the cleat is composed of relatively rigid material that appreciably flexes when compressed against a hard surface.

8. The turf protecting cleat of claim 7, wherein each turf-engaging member comprises a first generally radially extending member and a second generally circumferentially extending member.

9. The turf protecting cleat of claim 4, wherein the relatively rigid material does not appreciably flex when compressed against a turf surface.

10. A durable cleat for providing traction while preventing turf damage, comprising:

a base having an upper part configured to mate with an athletic shoe, a lower surface and an outer edge;

a plurality of projections protruding downwardly from the lower surface and extending outwardly toward the outer edge;

the cleat prevents damage to soft turf by having the projections arranged adjacent the outer edge of the cleat;

the cleat provides traction on soft turf by configuring the projections with a sloped surface that protrudes furthest down at the outer edge and sloping upwardly inside the An, outer edge;

the cleat provides durability against hard turf by configuring each sloped surface to flex toward a horizontal surface entirely below the lower surface of the base when compressed; and the cleat provides traction on hard turf by configuring the sloped surface to compress against the hard turf along the entire length of the projection.

11. The cleat of claim 10, wherein the cleat further provides traction on hard surfaces by configuring the projections to bear the weight of the wearer and preventing the base from contracting the turf.

12. The cleat of claim 10, wherein the cleat further provides durability by forming the cleat of material rigid enough to prevent the projections from compressing flush with the lower surface.

13. The cleat of claim 10, wherein the cleat further provides traction against turf by configuring the projections to form at least one angle as they extend outwardly toward the outer edge.

* * * * *

UNITED STATES PATENT AND TRADEMARK OFFICE

CERTIFICATE OF CORRECTION

PATENT NO. : 6,519,879 B2
APPLICATION NO. : 09/729755
DATED : February 18, 2003
INVENTOR(S) : Patrick Gee It is certified that error appears in the above-identified patent and that said Letters Patent is hereby corrected as shown below:

Column 5, line 8, claim 9, change "4", to read --7--.

Signed and Sealed this

Seventh Day of November, 2006

JON W. DUDAS
*Director of the United States Patent and Trademark Office*